United States Patent [19]

Satake

[11] 3,961,617

[45] June 8, 1976

[54] IGNITION DEVICE FOR AN INTERNAL COMBUSTION ENGINE

[75] Inventor: Yasuro Satake, Chino, Japan

[73] Assignee: Suwa Electric Wire Co., Ltd., Suwa, Japan

[22] Filed: Nov. 27, 1974

[21] Appl. No.: 527,529

[52] U.S. Cl. ..... 123/148 OC; 315/209 CD

[51] Int. Cl.[2] ..... F02P 1/00

[58] Field of Search ..... 123/148 OC, 148 E; 315/209 CD

[56] References Cited

UNITED STATES PATENTS

| | | | |
|---|---|---|---|
| 3,271,593 | 9/1966 | De Vilbiss | 123/148 OC |
| 3,297,911 | 1/1967 | Quinn | 123/148 OC |
| 3,306,275 | 2/1967 | Hufton | 123/148 OC |
| 3,714,507 | 1/1973 | Schweitzer et al. | 123/148 OC |
| 3,718,125 | 2/1973 | Posey | 123/148 OC |

*Primary Examiner*—Charles J. Myhre
*Assistant Examiner*—Ronald B. Cox
*Attorney, Agent, or Firm*—Merchant, Gould, Smith, Edell, Welter & Schmidt

[57] ABSTRACT

An ignition device for an internal combustion engine which comprises a DC-DC converter for stepping up battery voltage; a capacitor charged with output from said DC-DC converter; an SCR for discharging the electric energy stored in the capacitor through the primary side of an ignition coil; a circuit for igniting the SCR according to the operating condition of a contact breaker; a bias voltage source for rectifying output voltage from bias voltage-generating winding fitted to the oscillation voltage stepup transformer of the DC-DC converter and impressing the resultant negative output on the SCR gate and the resultant positive output of the SCR cathode; a transformer type coupling circuit connected between a circuit included in the DC-DC converter to generate high rectified output voltage and the capacitor, thereby coupling the DC-DC converter with the capacitor, wherein the transformer type coupling circuit prevents excess load from being applied on the DC-DC converter when the SCR is rendered conducting and the voltage generated on the secondary side of said transformer is added to output voltage from the DC-DC converter to provide an increased level of voltage.

5 Claims, 4 Drawing Figures

IGNITION DEVICE FOR AN INTERNAL COMBUSTION ENGINE

BACKGROUND OF THE INVENTION

This invention relates to an improved ignition device for an internal combustion engine, wherein output from a DC-DC converter connected to a battery charges a capacitor connected in series to the primary winding of an ignition coil, and electric energy stored in the capacitor is discharged through the primary winding in exact timing with the ignition of the internal combustion engine.

The so-called capacitor discharge type ignition device is the one wherein the stepped up voltage of a battery charges a capacitor connected in series to the primary winding of an ignition coil, and electric energy stored in the capacitor is discharged through the primary winding in synchronization with the ignition of the internal combustion engine to fire a gaseous mixture. The prior art capacitor discharge type ignition device is arranged, for example, as shown in FIG. 1. A DC-DC converter for stepping up the voltage of a battery 1 to high DC voltage comprises a circuit of resistors 3, 4 connected in series to the battery 1 through an ignition switch 2; a pair of oscillation transistors 5, 6; an oscillation voltage stepup transformer 7; a primary winding 8, a feedback winding 9 and secondary coil 10 constituting said transformer 7; and a rectification circuit consisting of diodes 11, 12, 13 and 14.

Positive output from the rectification circuit is supplied to one end of a resistor 15, the anode of an SCR 16 and one end of a capacitor 18. The capacitor is connected in series to the primary winding 20 of an ignition coil 19, the secondary winding 21 of which is connected to an ignition plug 22. The SCR 16 is connected in parallel with the primary winding 20.

Positive output from the battery 1 is delivered to a contact breaker 25 actuated by a cam 24 through the ignition switch 2 and resistor 23. A rectangular wave signal resulting from the intermittent actuation of the contact breaker 25 is differentiated by a differentiation circuit formed of a capacitor 26 and resistor 27. Positive differentiated pulses alone are impressed on the gate 17 of the SCR 16 through a diode 28.

When the ignition switch 2 is closed, the transistor 5, for example, is rendered conducting and the transistor 6 is kept in the turned off condition. Where current running through the transistor 5 is saturated at a prescribed level, voltage induced in the feedback winding 9 is reduced to zero, causing the transistor 5 to be turned off and the transistor 6 to be actuated. Where the transistor 6 is saturated, the transistor 5 is conversely rendered conducting. Thus, the above-mentioned oscillation circuit commences oscillation at a frequency of, for example, 8 KHz to 15 KHz. AC voltage impressed on the primary winding 8 is transformed to AC voltage of about 250 to 300 volts in the secondary coil 10 of the transformer 7. The latter AC voltage is rectified by the rectification circuit consisting of the diodes 11 to 14, and the resulting DC voltage is stored in the capacitor 18. On the other hand, the gate 17 of the SCR 16 is supplied with positive pulses generated when the contact breaker 25 is rendered OFF at the start of the internal combustion engine. As the result, the SCR 16 is rendered conducting, causing electric energy stored in the capacitor 18 to be rapidly discharged through the primary winding 20 of the ignition coil 19. Since the number of turns constituting the primary winding 20 and that of the secondary winding 21 of the ignition coil 19 generally bear the ratio of 1 : 100 to 1 : 150, as high voltage as 25000 to 45000 volts is impressed across the spark gap of the ignition plug 22, giving rise to discharges across said spark gap and in consequence igniting a gaseous mixture.

With the prior art ignition device arranged as described above, the discharge capacitor 18 is fully stored with rectification output from the DC-DC converter, where the internal combustion engine is driven at a relatively low speed, because one cycle of charge and discharge takes a long period. Where, however, said engine is driven at an increasing speed, then one cycle of charge and discharge is carried out in a shorter time, failing to attain the full charge of the capacitor 18. Namely, the SCR 16 is undesirably supplied with gating pulses while the capacitor 18 is not fully charged, resulting in the discharge of low electric energy. Accordingly, the discharge of an extremely small amount of electric energy fails to deliver full current to the ignition coil 19, leading to the supply of weak spark energy to the ignition plug 22 and in consequence the insufficient firing of a gaseous mixture.

To avoid the above-mentioned difficulties, it is necessary to store the discharge capacitor 18 with electric energy rapidly during the high speed drive of an internal combustion engine and, to this end, draw out high voltage output from the DC-DC converter. Where, however, high voltage output is generated by the DC-DC converter, then high voltage is also impressed between the anode and cathode of the SCR 16. Therefore, though expected to become nonconducting, the SCR 16 gets into operation under a very unstable condition, when impressed with voltage approaching a breakover level. For example, discharge is often commenced even when gating pulses are not supplied. Since output voltage from an alternator varies with the number of rotations of a driven internal combustion engine, the resultant change in the voltage at the terminal of the battery 1 charged with said alternator output affects output from the DC-DC converter. Thus any slight variation of voltage unnecessarily renders the SCR 16 conducting. The above-mentioned objectionable events take place independently of the application of gating pulses delivered to the SCR 16, leading to the disorderly rotation of the internal combustion engine. To this end, it may be considered to use the SCR which is capable of increasing high forward peak suppressing voltage. However, such type of an SCR is not preferred in respect of cost, manufacture and quality because it is expensive and bulky, has to be supplied with high input voltage for control of its gate, and makes a slow response to control.

SUMMARY OF THE INVENTION

It is accordingly the object of this invention to provide a highly reliable, compact and inexpensive ignition device for an internal combustion engine.

According to an aspect of this invention, there is provided a capacitor discharge type ignition device for an internal combustion engine capable of giving forth strong spark energy throughout the low and high speed drive of said engine, which comprises a bias voltage generator for impressing bias voltage of opposite polarity across the gate and cathode of an SCR to control the discharge of electric energy stored in a discharge capacitor, thereby increasing the forward peak suppressing voltage of the SCR and elevating the electric properties of the SCR, for example, its characteristics relative to the rate dv/dt at which the critical OFF voltage is stepped up; and a supplementary charging circuit for operating a circuit coupling a DC-DC converter with a discharge capacitor in synchronization with the ignition of the internal combustion engine, thereby facilitating the ON-OFF operation of the SCR by control of output from the DC-DC converter, reducing load on the DC-DC converter and battery, shortening the charging period of the discharge capacitor by supplying said capacitor with output from the DC-DC converter mixed with electromotive force induced in the secondary winding of a transformer to supplement deficient charge at the high speed drive of the internal combustion engine.

DESCRIPTION OF THE PREFERRED EMBODIMENTS

Figure 1:
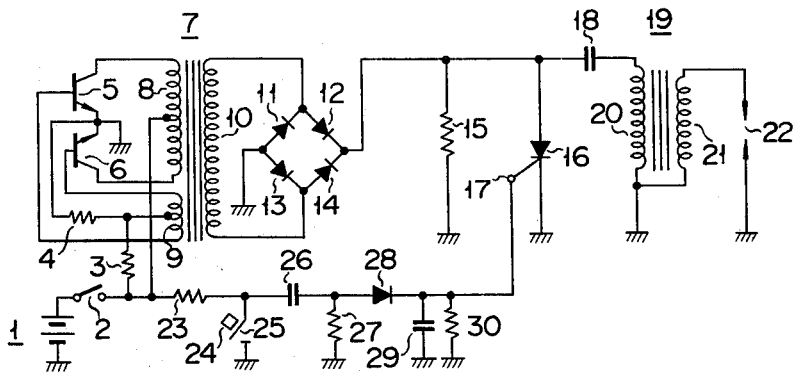
FIG. 1 PRIOR ART
FIG. 1 is a circuit arrangement of a prior art capacitor discharge type ignition device for an internal combustion engine.
Figure 2:
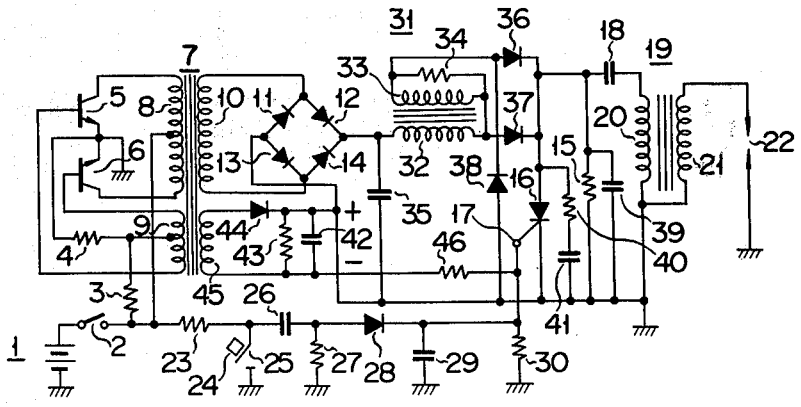
FIG. 2 is a circuit arrangement of a capacitor discharge type ignition device according to an embodiment of this invention for an internal combustion engine.
Figure 3:
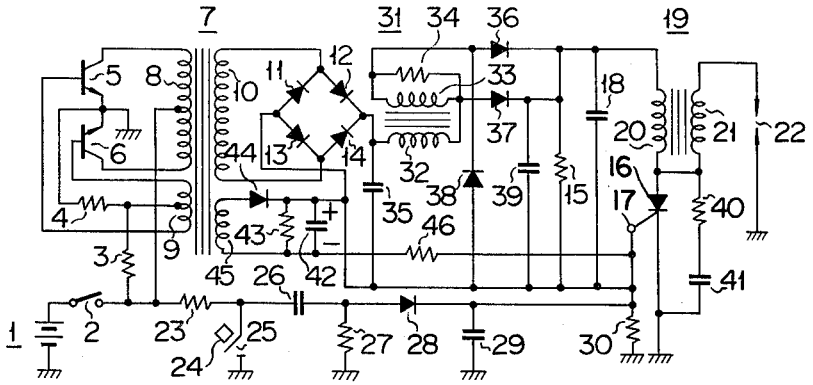
FIG. 3 is a circuit arrangement of the capacitor discharge type ignition device of the invention modified from FIG. 2.
Figure 4:
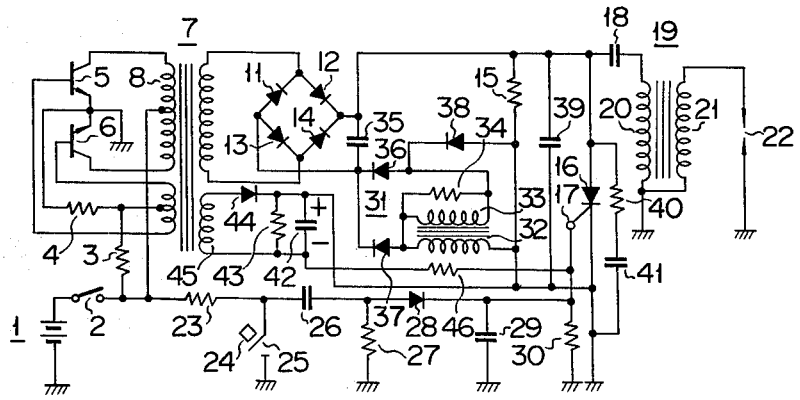
FIG. 4 is a circuit arrangement of a capacitor discharge type ignition device according to another embodiment of the invention.

The parts of FIGS. 2 to 4 the same as those of FIG. 1 are denoted by the same numerals, description thereof being omitted. Referring to FIG. 2 an oscillation voltage stepup transformer 7 is provided with a bias voltage generating winding 45. This winding 45 constitutes a DC bias voltage generator together with a capacitor 42, resistor 43, and diode 44 which are all connected between both terminals of said winding 45. The positive output terminal of said bias voltage generator is connected to the cathode of the SCR 16 and the negative output terminal thereof to the gate 17 of said SCR 16 through a resistor 46. Thus, the SCR 16 is applied with a reversed bias voltage between its gate and cathode. This DC bias voltage increases the forward peak suppressing voltage of the SCR 16 and raises a limit to the critical OFF voltage stepup rate dv/dt, thereby enabling the DC-DC converter to generate higher rectified voltage and the later described mixing of voltages to be carried out effectively. Impression of the above-mentioned reversed bias voltage across the gate and cathode of the SCR 16 is effective to suppress the undesirable temporary turnon of the SCR 16 caused by variation in the voltage applied to the anode of the SCR 16 during the engine drive and also shortens the time required to control a minimum holding current when the SCR 16 has its condition transferred from ON to OFF.

Reverting to FIG. 2, the positive output terminal of the rectification circuit having the diodes 11 to 14 is connected to one end of a primary winding 32 of a transformer 31. The other terminal of said primary winding 32 is connected to one end of a secondary winding 33, one end of a resistor 34 and the anode of a diode 37. The other ends of the secondary winding 33 and resistor 34 are jointly connected to the anode of a diode 36. The cathodes of the diodes 36, 37 are jointly connected to one end of the discharge capacitor 18. A capacitor 35 is connected between the positive and negative output terminals of the aforesaid diode rectification circuit. A diode 38 is connected between the negative output terminal of said rectification circuit and the anode of the diode 36 in opposite polarity to that of the D.C. source. A capacitor 39 is connected in parallel to the resistor 15, and a circuit consisting of series connected resistor 40 and capacitor 41 is connected in parallel to the SCR 16.

Where gating pulses are impressed on the gate 17 of the SCR 61 during operation, electric energy stored in the discharge capacitor 18 is discharged through the SCR 16, and output from the DC-DC converter runs through the primary winding 32 and diode 37. In this case, however, the inductance of the primary winding 32 obstructs the flow of current from the DC-DC converter, preventing said converter from being overloaded. Where the impedance of the primary winding 32 is so set at the moment of discharge as to reduce current passing through the SCR 16 to a lower level than its minimum holding current, then the SCR 16 has its condition easily transferred from ON to OFF or vice versa. After the turn off of the SCR 16, current momentarily delayed by being controlled through the self induction of the primary winding 32 is charged in the discharge capacitor 18 through the rectified output terminal of the DC-DC converter. As the result, said discharge capacitor 18 is charged and discharged fully separately.

The ON-OFF cycle of the SCR 16 which is carried out in synchronization with the ignition of the internal combustion engine is more often repeated as the engine is driven at a higher speed. The mount of current flowing through the primary winding 32 of the transformer 31 varies with the ON and OFF conditions of the SCR 16. With an internal combustion engine of, for example, the 4 cycle-4 cylinder type, 33 Hz pulsating current passes through the primary winding 32 at the 1000 rpm rotation of said engine and 333 Hz pulsating current runs therethrough at 10000 rpm. The secondary winding 33 of the transformer 31 is impressed with voltage corresponding to the frequency of pulsating current traveling through the primary winding 32. Where the voltage generated in the secondary winding 33 is made to have the same polarity as output from the DC-DC converter at the moment the SCR 16 is turned off, then voltage consisting of a sum of the voltage of the secondary winding 33 and output voltage from the DC-DC converter is impressed on the discharge capacitor 18 through the diode 36.

Thus, the higher the running speed of the internal combustion engine, the larger the amount of electric energy stored in the discharge capacitor 18, and in consequence the shorter the charging time. Accordingly, the ignition plug 22 always gives forth powerful sparks at any rotation of the internal combustion engine.

Since the discharge capacitor 18 is impressed with higher charge voltage than output voltage from the DC-DC converter, the diodes 36, 37 of the transformer type coupling circuit are concurrently used to prevent the back flow of current from the discharge capacitor 18 to the DC-DC converter, the occurrence of electromotive force of opposite polarity in the primary and secondary windings 32, 33, and further suppress the short circuiting of the secondary winding 33. The resistor 34 is intended to control the voltage induced in the secondary winding 33. Control of said induced voltage adjusts the aforesaid mixed voltage to an optimum level. The diode 38 is used to bypass back electromotive force induced in the secondary winding 33, and the capacitor 39 to bypass high frequency current. The resistor 15 is intended to suppress the leakage of current from the discharge capacitor 18. The resistor 40 and capacitor 41 jointly constitute the snubber circuit of the SCR 16. The capacitor 35 is used to smooth out and store rectified output from the DC-DC converter.

The circuit arrangement of FIG. 3 of an ignition device according to this invention is modified from that of FIG. 2. According to the circuit arrangement of FIG. 3, the anode of the SCR 16 of the discharge circuit is connected to the grounding side of the primary winding of the ignition coil 19. The discharge capacitor 18 is connected to the output terminal of the transformer type coupling circuit, namely, between the common junction of the cathodes of the diodes 36, 37 and the ground. Where the gate 17 of the SCR 16 is supplied with gating pulses, electric energy stored in the discharge capacitor 18 passes from the primary winding 20 of the ignition coil 19 to the SCR 16. The other operations of the circuit arrangement of FIG. 3 are the same as in FIG. 2.

FIG. 4 shows another embodiment of this invention, wherein the transformer type coupling circuit is connected to the negative pole side (ground) of rectified output from the DC-DC converter. Namely, the cathodes of the diodes 36, 37 of the transformer type coupling circuit are connected to the negative output terminal of the rectification circuit including the diodes 11 to 14, and one end of the primary winding 32 of the transformer 31 is grounded. In this case, the transformer type coupling circuit is connected to the negative terminal (ground side) of the rectification circuit, offering the advantage of enabling the component parts to have a small value of withstand voltage. The circuit arrangement of FIG. 4 is operated fundamentally in the same manner as in FIG. 2, description thereof being omitted.

Throughout the embodiments of FIGS. 2 to 4, the SCR 16 is supplied with reversed bias voltage delivered from the secondary winding 45 of the oscillation voltage stepup transformer 7. Therefore the level of said bias voltage varies with output voltage from the alternator which also changes with the number of rotations of the internal combustion engine. Namely, the SCR 16 is impressed with higher reversed bias voltage than prescribed when said engine is driven more rapidly, thereby increasing the forward peak suppressing voltage of SCR 16. Where said engine is run at a slower speed, then the SCR 16 is supplied with lower reversed bias voltage than prescribed, enabling the SCR 16 to have its condition more easily transferred from ON to OFF or vice versa. This means that the SCR 16 is impressed with an optimum amount of reversed bias voltage matching the number of rotations of the internal combustion engine.

What is claimed is:

1. An ignition device for an internal combustion engine which comprises a DC-DC converter operatively connected to receive the output voltage of a battery and including an oscillation voltage stepup transformer for increasing the battery voltage; a discharge capacitor charged with output from said DC-DC converter; a transformer type circuit for coupling said DC-DC converter with said discharge capacitor including a transformer provided with a primary winding, a first terminal of which is connected to the positive output terminal of said DC-DC converter and a secondary winding, a first terminal of which is connected to a second terminal of said primary winding, a first diode connected between said second terminal of said primary winding and said discharge capacitor, and a second diode connected between a second terminal of said secondary winding and said discharge capacitor; an SCR for discharging electric energy stored in said discharge capacitor through the primary winding of an ignition coil; an ignition circuit for triggering said SCR responsive to the operation of a contact breaker; and biasing means for impressing reversed bias voltage across the gate and cathode of said SCR.

2. An ignition device according to claim 1, wherein said DC-DC converter comprises an oscillation voltage stepup transformer provided with a primary winding, a feedback winding and a secondary winding; first and second transistors connected in series to both ends of said primary winding of said oscillation voltage stepup transformer in opposite polarities, the bases of said first and secnd transistors being connected to the corresponding ends of said feedback winding; at least one resistor connected between the common junction of said first and second transistors and the positive output terminal of the battery; and a diode bridge rectification circuit connected between both terminals of said secondary winding of said oscillation voltage stepup transformer.

3. An ignition device according to claim 1, wherein said ignition circuit comprises a differentiation circuit for differentiating a rectangular wave signal resulting from the intermittent operation of the contact breaker; a diode clipping circuit for passing only positive pulses of the differentiated output signal from said differentiation circuit; and means for supplying the gate of said SCR with positive output pulses from the diode clipping circuit.

4. An ignition device according to claim 1, wherein the reversed a bias voltage-impressing means comprises bias winding provided on the secondary side of the oscillation voltage stepup transformer; a rectification circuit for rectifying voltage induced across both terminals of the bias winding; and connecting means for impressing positive output from said rectification circuit on the cathode of said SCR and negative output from said rectification circuit on the gate of said SCR.

5. An ignition device according to claim 1, wherein said transformer type coupling circuit comprises first and second diodes, the cathodes of which are connected to the negative output terminal of said DC-DC converter; and a transformer provided with a primary winding connected between the anode of said first diode and the cathode of said SCR and a secondary winding connected between the anodes of said first and second diodes.

* * * * *

UNITED STATES PATENT OFFICE

CERTIFICATE OF CORRECTION

Patent No. 3,961,617 Dated June 8, 1976

Inventor(s) Yasuro Satake

It is certified that error appears in the above-identified patent and that said Letters Patent are hereby corrected as shown below:

Column 6, line 28, "setnd" should read -- second --.

Column 6, line 47, "the" should read -- said --.

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

PATENT NO. : 3,961,617

DATED : June 8, 1976

INVENTOR(S) : Yasuro Satake

It is certified that error appears in the above-identified patent and that said Letters Patent are hereby corrected as shown below:

In column 6, line 47, the word "a" following the word "reversed" should be deleted; and in line 47, the word "a" should be inserted after the word "comprises".

Signed and Sealed this

Eighth Day of March 1977

[SEAL]

*Attest:*

RUTH C. MASON
*Attesting Officer*

C. MARSHALL DANN
*Commissioner of Patents and Trademarks*